United States Patent [19]

Hoshi et al.

[11] 4,251,270

[45] Feb. 17, 1981

[54] METHOD OF CONTROLLING STEEL MAKING PROCESS UNDER ATMOSPHERIC PRESSURE

[75] Inventors: Fumio Hoshi; Yuzo Saita, both of Tokuyama; Akira Fujisawa, Kyoto, all of Japan

[73] Assignee: Nisshin Steel Co., Ltd., Japan

[21] Appl. No.: 938,014

[22] Filed: Aug. 30, 1978

[30] Foreign Application Priority Data

Sep. 10, 1977 [JP] Japan ..... 52-109246

[51] Int. Cl.[3] ..... C21C 5/30

[52] U.S. Cl. ..... 75/60; 75/59

[58] Field of Search ..... 75/59, 60

[56] References Cited

U.S. PATENT DOCUMENTS

| | | | |
|---|---|---|---|
| 3,649,246 | 3/1972 | Fulton | 75/60 |
| 3,666,439 | 5/1972 | Ramachandran | 75/60 |
| 3,720,404 | 3/1973 | Carlson | 75/60 |
| 3,748,122 | 7/1973 | Ramachandran | 75/60 |
| 3,920,447 | 11/1975 | Schroeder | 75/60 |
| 3,940,263 | 2/1976 | Morello | 75/60 |

*Primary Examiner*—P. D. Rosenberg

*Attorney, Agent, or Firm*—Kane, Dalsimer, Kane, Sullivan and Kurucz

[57] ABSTRACT

Method of controlling steel making process under atmospheric pressure, comprising forming an intimate mixture of an exhaust gas and a measured quantity of a reference gas; mass spectrometrically monitoring a sample of the mixture for the ionization currents for selected peaks with which the CO, $CO_2$, $N_2$ and reference gas in the sample are concerned; determining the rate or amount of decarburization of the molten steel from the measured value of the quantity of the reference gas in the mixture and the measured values of the ionization currents, and; controlling the process according to the determined value of the rate or amount of decarburization.

10 Claims, 3 Drawing Figures

METHOD OF CONTROLLING STEEL MAKING PROCESS UNDER ATMOSPHERIC PRESSURE

BACKGROUND OF THE INVENTION

1. Field of the Invention

The present invention relates to a method for a dynamic or real time control of a steel making process involving decarburization of molten steel under atmospheric pressure and formation of an exhaust gas comprising CO, $CO_2$ and $N_2$. Particularly, the present invention relates to such a method wherein the carbon content of the steel at the end point of the decarburization process may be precisely controlled to a preset value by promptly detecting the carbon content or rate of decarburization of the molten steel being processed at any desired instance and by controlling the process in accordance with the detected carbon content or rate of decarburization.

2. Brief Description of the Prior Art

Widely practiced is a steel making process under atmospheric pressure which involves decarburization of molten steel. In such a process, molten steel is decarburized in a top- or bottom-blown converter, or in an AOD (argon-oxygen decarburizing) furnace, to a preset level of carbon content to produce an intended steel.

Recent progress in the art has made it possible to produce various kinds of steel, and in consequence, it has become increasingly important to promptly detect and determine certain parameters indicative of the state of the molten steel being processed and to control the process in accordance with the determined values of the parameters so that the desired steel may be produced. Among others detection of the carbon content of the molten steel being processed is particularly important, because the primary object of the process is to decarburize the molten steel.

Determination of the carbon content in the molten steel being processed may be carried out by stopping blowing of oxygen, sampling the molten steel (in the case of a converter, after inverting the converter), and analysing the sampled steel as promptly as possible. However, such a sampling of the molten steel and analysis thereof are extremely burdensome operations. It would be advantageous from view points of both process efficiency and product quality, if it is possible to precisely determine the carbon content of the molten steel being processed without the need of sampling of the molten steel and subsequent analysis thereof.

An approach to the problem is based on measurement of the amount of carbon which has been transferred to the exhaust gas, that is the quantities of CO and $CO_2$ in the exhaust gas, instead of measurement of the amount of carbon remaining in the molten steel. For this approach it is essentially required to precisely detect not only the quantities of CO and $CO_2$ in the exhaust gas but also the quantity of the entire exhaust gas every moment. There has been an attempt to determine the carbon content of the molten steel being processed by monitoring the flow rate of exhaust gas by means of a differential pressure flowmeter provided in an exhaust gas duct and by monitoring the contents of CO and $CO_2$ in a sample of the exhaust gas by means of infrared gas analyzers. However, no satisfactory results have been obtained by such an attempt. This is partly because an extremely large amount of an exhaust gas is allowed to flow through a duct of a large cross-section in a steel making process under atmospheric pressure, and the temperature of the exhaust gas extensively varies in the course of the process, making it difficult to precisely detect the quantity of the exhaust gas with an instrument such as a differential pressure flowmeter, and; partly because analyzers such as an infrared gas analyzer had a limited precision and response speed. Furthermore, the fact that different infrared gas analyzers are required for detecting different gaseous components in a sample of the exhaust gas poses difficulties in handling errors and time-lags of the respective analyzers. Accordingly, it has been very difficult to precisely determine the content of carbon in the molten steel being processed from information about the exhaust gas every moment. Values of the carbon content found by the prior art method frequently fluctuate to a great extent, and a probability with which the determined values make a good hit with acceptable precision is in the order of about 60 to 80%. Particularly, in a steel making process carried out under atmospheric pressure, atmospheric air inevitably entering the exhaust gas affects the quantity of the gas and makes it further difficult to obtain precise information on the molten steel from that on the exhaust gas.

In Japanese Patent Laid-open Specification No. 50(1975)-99592, published on Aug. 7, 1975 and assigned to the assignee of the present application, we have disclosed a method of determining the quantity of a gas formed in a gas producing chamber, such as the quantity of steam formed in a drier. The method proposed therein comprises the steps of feeding a dummy gas to the gas producing chamber, monitoring the quantity of the dummy gas fed to the gas producing chamber as well as the partial pressures of the dummy gas and the gas formed contained in an exhaust gas, and determining the quantity of the gas formed from the monitored values. The laid-open specification further teaches that the partial pressure of the gases may be advantageously measured by a mass spectrometer, and suggests that the proposed method may be applicable for determination of gases formed in a steel making furnace. However, this laid-open specification is completely silent with respect to difficulties inherently involved in mass spectrometrical analysis of a gas comprising CO, $CO_2$ and $N_2$. In fact, parent peaks for CO and $N_2$ in a mass spectrum are inseparable because CO and $N_2$ have the same mass number of 28. Furthermore, a fragment peak for $CO_2$ appears at a mass number of 28 and perturbs the parent peak for CO which also appears at the same mass number.

SUMMARY OF THE INVENTION

An object of the invention is to provide a method for a dynamic control of a steel making process which is carried out at ambient pressure and involves decarburization of molten steel and formation of an exhaust gas comprising CO, $CO_2$ and $N_2$. A method in accordance with the invention comprises the steps of forming an intimate gaseous mixture of the exhaust gas and a measured quantity of a reference gas which is inert to the exhaust gas; mass spectrometrically monitoring a sample of said intimate mixture for the ionization currents for selected peaks with which the CO, $CO_2$, $N_2$ and reference gas in said sample are concerned; determining the rate or amount of decarburization of the molten steel at the time of monitoring from the measured value of the quantity of the reference gas in said mixture and the measured values of the ionization currents for the selected peaks, and; controlling the steel making process in accordance with the determined value of the rate or amount of decarburization of the molten steel.

BRIEF EXPLANATION OF THE DRAWINGS

A more complete appreciation of the invention and many of the attendant advantages thereof will readily be obtained as the same becomes better understood by reference to the following detailed description when considered in connection with the accompanying drawings, in which.

DETAILED DESCRIPTION OF THE INVENTION

Figure 1:
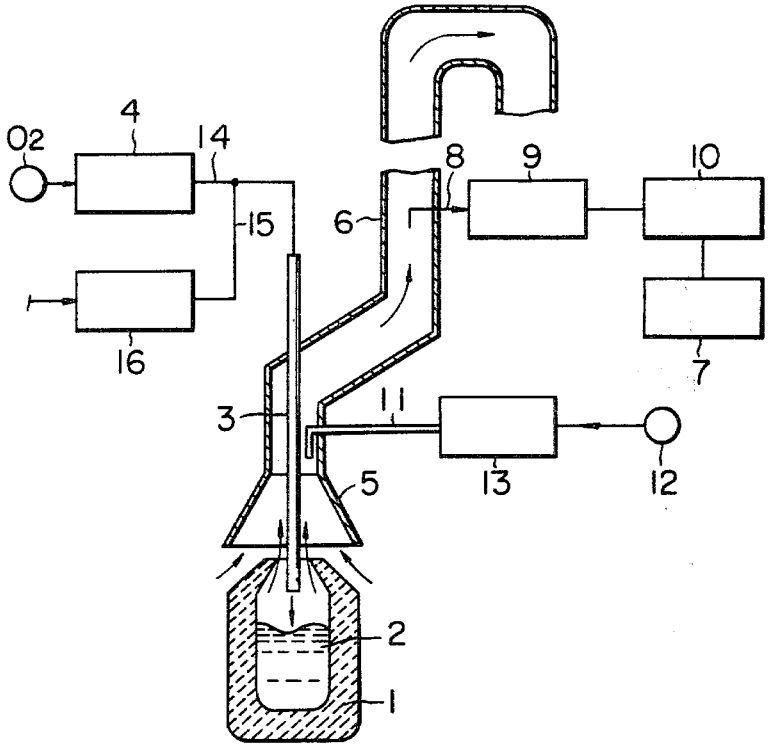
FIG. 1 illustrates an arrangement of instruments which may be used in an embodiment of the method of the invention for controlling a steel making process carried out in a top-blown converter under atmospheric pressure.

In an embodiment shown in FIG. 1, decarburization of steel is carried out in a top-blown converter 1 by blowing oxygen onto molten steel 2 in the converter from lance 3. The amount of oxygen blown from the lance is controlled by a pressure and flow controller 4. Above the position where a top opening of the converter comes when the converter stands upright, there is provided an exhaust gas hood 5 spaced from the top opening of the converter. Exhaust gas collected in the hood 5 is removed out of the system through a duct 6. In the course of decarburization a large quantity of hot exhaust gas is formed and caused to flow through the duct 6. The gas comprises CO and $CO_2$ formed by the decarburization of the molten steel 2, unreacted oxygen blown from the lance 3, air sucked through the clearance between the converter 1 and hood 5, and various dust materials. Nevertheless, substantially all of the CO and $CO_2$ formed in the decarburization process is caused to flow through the duct 6. Accordingly the amounts of CO and $CO_2$ flowing through the duct 6 correspond to the amount of decarburization.

In accordance with the invention a mass spectrometer is utilized to determine the amounts of CO and $CO_2$ flowing through the duct 6. A sample of the gas flowing through the duct 6 is introduced to a sample inlet system (not shown) of a mass spectometer 7 from a gas inlet pipe 8 through a filter 9 by means of a suction pump 10. For successful measurements by the mass spectrometer 7, the duct 6 is provided with a reference gas inlet pipe 11 at a location at least a predetermined distance upstream of the gas inlet pipe 8 so that a reference gas 12 may be introduced through the pipe 11 to the exhaust gas system while being precisely metered by a flow meter 13. Depending upon the nature of the reference gas, it may be introduced to the system through the lance 3. For this purpose an oxygen piping 14, which communicates the pressure and flow controller 4 with the lance 3, is provided with a branch piping 15 for introducing a reference gas which has been metered by a flowmeter 16.

Figure 2:
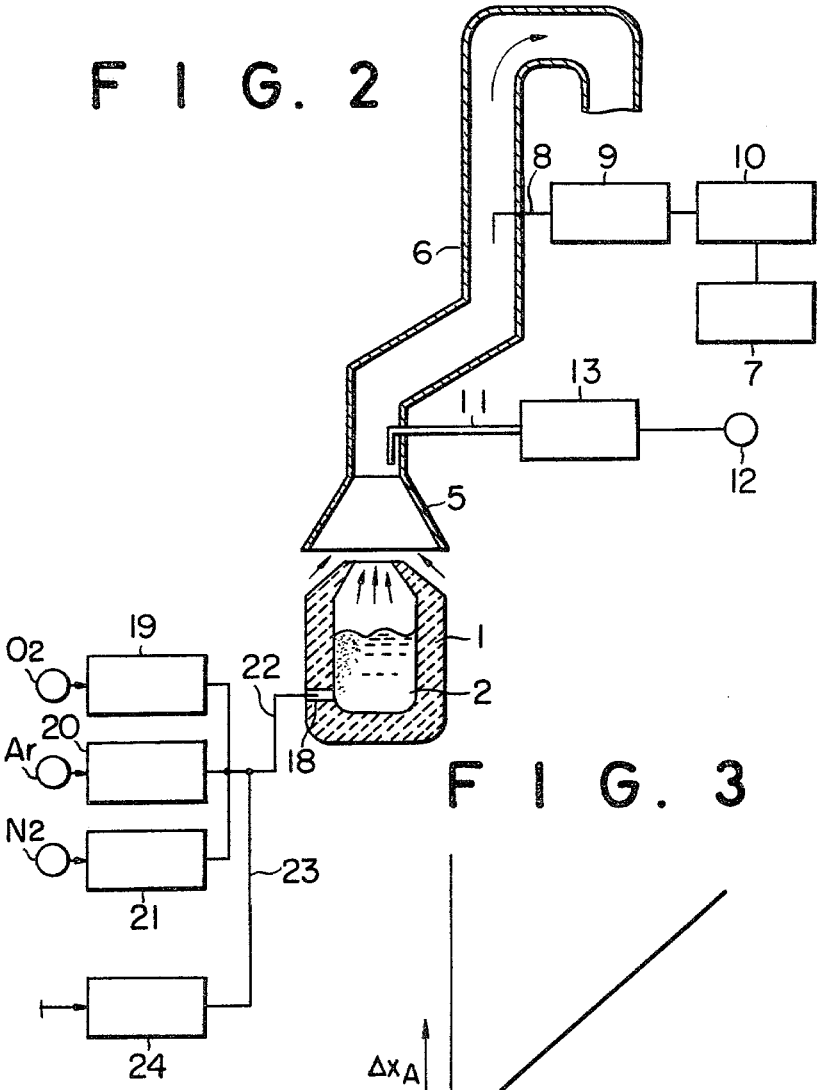
FIG. 2 illustrates an arrangement of instruments which may be used in an embodiment of the method of the invention for controlling a steel making process carried in an AOD furnace under atmospheric pressre.

In an embodiment shown in FIG. 2, decarburization of steel is carried out in an AOD furnace. The installation shown in FIG. 2 is the same as that shown in FIG. 1 except that the converter 1 is provided with a tuyere 18 at or near the bottom thereof so that gases required for the AOD process may be blown into the molten steel 2 in the converter 1. These gases may be oxygen, argon and nitrogen, the amounts of which are controlled by pressure and flow controllers 19, 20 and 21, respectively. The gases are passed to the tuyere 18 through a piping 22, which is provided with a branch piping 23 so that a reference gas may, depending upon its nature, be introduced through the piping 23 to the system in accordance with the invention after having been pricisely metered by a flowmeter 24. In FIGS. 1 and 2, the same reference numerals designate the same parts.

In a method according to the invention, the amount of flow of the reference gas introduced to the system through the reference gas inlet pipe 11 or through the piping 15 or 23 is monitored at a given instance, and at the same time a sample of the exhaust gas is mass spectrometrically analyzed for the ionization currents for peaks at selected mass numbers. Based on the so measured value of the amount of flow of the reference gas and the so measured values of the ionization currents for selected peaks, the amount or rate of decarburization at that instance is determined. How to carry out such a determination will now be described with reference to typical and preferred embodiments of the invention.

As already stated, in the decarburization process carried out at atmospheric pressure, the exhaust gas flowing through the duct 6 contains a large quantity of nitrogen. This nitrogen has a mass number (m/e) of 28 which is the same as that of CO, and thus, the parent peak for nitrogen coincides with that for CO. Accordingly, a measured value of the ionization current for the parent peak of CO cannot be utilized for the CO's own representation. Furthermore, both divalent ion peaks of $N_2$ and CO appear at m/e of 14, and a fragment peak of $CO_2$ appears at m/e of 28. All these facts make it difficult to mass spectrometrically determine CO and $CO_2$ contents in a gas which contains $N_2$ in addition to the CO and $CO_2$.

One of the essential feature of the invention resides in the selection of peaks for which the ionization currents are to be monitored. In accordance with one embodiment of the invention we have selected not only parent peaks but also certain divalent ion and fragment peaks with which CO, $CO_2$ and $N_2$ in the sample are concerned. It is preferred to select the peaks appearing at mass numbers of 12, 14, 28 and 44, and to monitor the ionization currents at these mass numbers as well as that for the parent peak of the reference gas used.

From the so measured values of the ionization currents for the selected peaks, the partial pressures of the CO and $CO_2$ in the sample are calculated while allowing for sensitivities and pattern coefficients of the CO, $CO_2$ and $N_2$. The so calculated values of the partial pressures of the CO and $CO_2$, the separately monitored change in the quantity of the reference gas introduced to the system, a mass spectrometrically measured value of the change in the ionization current for a peak, preferably the parent peak, of the reference gas and a sensitivity for the reference gas, are then utilized to calculate the contents of the CO and $CO_2$ in the sample, and; finally the amount or rate of decarburization of the molten steel at the time of measurements is determined from the calculated values of the contents of CO and $CO_2$ by integration or differentiation.

CALCULATION OF PARTIAL PRESSURES OF CO AND $CO_2$

With respect to the exhaust gas system under discussion, the following equations (1), (2), (3) and (4) are materialized.

$$X_{12}=S_{CO}\cdot\pi_{CO\cdot12}\cdot P_{CO}+S_{CO2}\cdot\pi_{CO2}\cdot\pi_{CO2\cdot12}\cdot P_{CO2} \quad (1)$$

$$X_{14}=S_{CO}\cdot\pi_{CO\cdot14}\cdot P_{CO}+S_{N2}\cdot\pi_{N2\cdot14}\cdot P_{N2} \quad (2)$$

$$X_{28}=S_{N2}\cdot P_{N2}+S_{CO}\cdot P_{CO}+S_{CO2}\cdot\pi_{CO2\cdot28}\cdot P_{CO2} \quad (3)$$

$$X_{44}=S_{CO2}\cdot P_{CO2} \quad (4)$$

In these equations, $X_{12}$, $X_{14}$, $X_{28}$ and $X_{44}$ represent ionization currents (in ampere) at mass numbers (m/e) of 12, 14, 28 and 44, respectively;

$S_{CO}$, $S_{N2}$ and $S_{CO2}$ represent sentivities (in ampere/torr) of the mass spectrometer for CO, $N_2$ and $CO_2$, respectively;

$\pi_{CO\cdot14}$ and $\pi_{N2\cdot14}$ are pattern coefficients, to a mass number (m/e) of 14, of CO and $N_2$, respectively;

$\pi_{CO\cdot12}$ and $\pi_{CO2\cdot12}$ are pattern coefficients, to mass number (m/e) of 12, of CO and $CO_2$, respectively;

$\pi_{CO2\cdot28}$ is a pattern coefficient of $CO_2$ to a mass number (m/e) of 28, and;

$P_{CO}$, $P_{N2}$ and $P_{CO2}$ represent partial pressures, in the exhaust gas, of CO, $N_2$ and $CO_2$, respectively.

The values of the ionization currents $X_{12}$, $X_{14}$, $X_{28}$ and $X_{44}$ are measured by the mass spectrometer 7. The sensitivities $S_{CO}$, $S_{N2}$ and $S_{CO2}$ as well as the pattern coefficients $\pi_{CO\cdot12}$, $\pi_{CO\cdot14}$, $\pi_{CO2\cdot12}$, $\pi_{CO2\cdot28}$ and $\pi_{N2\cdot14}$ are values inherent to the mass spectrometer 7 under particular conditions of measurements, and, therefore are already known or can be determined by preliminary experiments. Accordingly, it will be noted that there are 4 equations (1) through (4), for 3 variables, $P_{CO}$, $P_{N2}$ and $P_{CO2}$. Thus, the values of $P_{CO}$, $P_{N2}$ and $P_{CO2}$ can be calculated from these 4 equations, by the so-called least-squares method. Alternatively, a set of three equations, for example, (4), (1) and (2); (4), (2) and (3), or; (4), (1) and (3), may be selected to calculate the values of $P_{CO}$, $P_{N2}$ and $P_{CO2}$. Of course the selection should be desirably made so that any possible errors may be minimized. For example, if any hydrocarbons are present in the sample of the exhaust gas, a fragment peak thereof frequently appears at a mass number of 12, and perturbs the value of $X_{12}$. If such a perturbation due to hydrocarbons cannot be neglected, it is preferred to select equations (2), (3) and (4) for calculating the partial pressures. It has also been found that when a solution from a set of suitably selected three equations is utilized for actual control of the decarburization process, other sets of three equations may be advantageously utilized for sequence check of a computer or for maintenance check of the mass spectrometer.

CALCULATION OF CONTENTS OF CO AND $CO_2$

Once the partial pressures of the CO and $CO_2$ in the exhaust gas have been determined, the contents of the CO and $CO_2$ in the exhaust gas may be theoretically determined by the following equations:

$$q_{CO}=(P_{CO}/P)\times Q$$

$$q_{CO2}=(P_{CO2}/P)\times Q$$

wherein $q_{CO}$ and $q_{CO2}$ respectively represent the contents of the CO and $CO_2$ in the exhaust gas, $P_{CO}$ and $P_{CO2}$ are the calculated values of the partial pressures of the CO and $CO_2$, respectively, P represents the total pressure of the exhaust gas, and Q represents the quantity of the exhaust gas. However, it is very difficult and impractical, although not impossible, to precisely determine the quantity of the exhaust gas formed in the steel making process, which involves decarburization of molten steel at atmospheric pressure.

One of the essential features of the invention resides in the fact that the contents of the CO and $CO_2$ in the exhaust gas, i.e., $q_{CO}$ and $q_{CO2}$ are determined without the necessity of measuring the overall quantity of the exhaust gas. As already stated, in a method according to the invention a reference gas A is introduced to the system from the reference gas inlet pipe 11 or from the lance 3 or tuyere 18, while being precisely metered. A change in the quantity of the reference gas, $\Delta q_A$, and a change in the ionization current for a peak, preferably the parent peak, of the reference gas A, $\Delta X_A$ (in ampere) are monitored. Accordingly, provided that the reference gas A introduced to the system has uniformly been dispersed in the exhaust gas, the following equations (5) and (6) are materialized:

$$\Delta X_A=S_A\cdot\Delta P_A \quad (5)$$

$$Q/P=\Delta q_A/\Delta P_A \quad (6)$$

wherein $\Delta X_A$, Q, P and $\Delta q_A$ are as defined herein above, $S_A$ (in ampere/torr) is a sensitivity of the mass spectrometer 7, for the reference gas, and $\Delta P_A$ represents a change in the partial pressure of the reference gas in the exhaust gas. From the equations (5) and (6), the following equation (7) directly follows:

$$Q/P=(S_A/\Delta X_A)\cdot\Delta q_A \quad (7)$$

Thus, $q_{CO}$ and $q_{CO2}$ can be calculated in accordance with the equations (8) and (9), $$q_{CO}=P_{CO}\cdot(Q/P)=(S_A/\Delta X_A)\cdot\Delta q_A\cdot P_{CO} \quad (8)$$

$$q_{CO2}=P_{CO2}\cdot(Q/P)=(S_A/\Delta X_A)\cdot\Delta q_A\cdot P_{CO2} \quad (9)$$

from the calculated values of $P_{CO}$ and $P_{CO2}$, the measured value of the change in the amount of flow of the reference gas, $\Delta q_A$, the measured value of the change of the ionization current for the parent peak of the reference gas, $\Delta X_A$, and the known or predetermined sensitivity of the mass spectrometer for the reference gas, $S_A$.

DETERMINATION OF AMOUNT OF DECARBURIZATION

We can now express the rate of decarburization of the molten steel at the time of t, dC/dt, as follows.

$$-(dC/dt)=K[q_{CO}(t)+q_{CO2}(t)] \quad (10)$$

wherein $q_{CO}(t)$ and $q_{CO2}(t)$ are quantities of CO and $CO_2$, respectively, at the time of t in the course of the decarburization process, and K is a constant. Accordingly, the amount of decarburization as of the time t, ΔC (in %) will be determined as follows.

$$\Delta C = K' \int_0^t W(t)[q_{CO}(t) + q_{CO_2}(t)]dt + B \quad (11)$$

wherein K' is a constant, W(t) is a function of time t relating to the expected weight of the molten metal at the time of t, and B is a bias coefficient.

Thus, by monitoring $X_{12}$, $X_{14}$, $X_{28}$, $X_{44}$ and $\Delta X_A$ by means of the mass spectrometer 7 and also $\Delta q_A$ by means of the flowmeter 13, 16 or 24, the amount of decarburization of the molten steel ΔC (in %) can be determined. The determination can be made instantaneously by transmitting the output signals of the mass spectrometer and flowmeter to a computer having a program for solution of the equations (1) through (4) and (8) through (11), for real time processing.

Thus, in one embodiment of the method of the invention, the sample of the intimate mixture of the exhaust and reference gases is mass spectrometrically monitored for the ionization currents for peaks appearing at mass numbers of 12, 14, 28 and 44, and for the ionization current for the parent peak of the reference gas; the partial pressures of the CO and $CO_2$ in said exhaust gas are calculated from the measured values of the ionization currents for the peaks at mass numbers of 12, 14, 28 and 44; the quantities of the CO and $CO_2$ in said exhaust gas are calculated from the calculated values of the partial pressures of the CO and $CO_2$, the measured value of the quantity of the reference gas in said mixture or the value of its change with time, and the measured value of the ionization current for the parent peak of the reference gas or the value of its change with time, and; the rate or amount of decarburization of the molten steel at the time of monitoring is determned from the calculated values of the quantities of the CO and $CO_2$ in said exhaust gas.

In another embodiment of the method of the invention the sample of the intimate mixture of the exhaust and reference gases is mass spectrometrically monitored for $X_{44}$, the ionization current for a peak appearing at a mass number of 44, Xn and Xm selected from the group consisting of $X_{12}$, $X_{14}$ and $X_{28}$, the ionization currents for peaks appearing at mass numbers of 12, 14 and 28, respectively, and $X_A$, the ionization current for the parent peak of the reference gas; $q_{CO}+q_{CO_2}$, the sum of the quantities of the CO and $CO_2$ in the exhaust gas is determined in accordance with the equation:

$$q_{CO}+q_{CO_2}=(\Delta q_A/\Delta X_A)(a_1Xn+a_2Xm+a_3X_{44})+\alpha \quad (12)$$

wherein $\Delta q_A$ is the change with time of the value of the measured quantity of the reference gas in said mixture, $\Delta X_A$ is the change in $X_A$ with time, $a_1$, $a_2$ and $a_3$ are constants predetermined by carrying out the steel making process at least three times, α is a bias coefficient, and $q_{CO}+q_{CO_2}$, $X_A$, Xn, Xm and $X_{44}$ are as hereinabove defined; and; the rate or amount of decarburization of the molten steel at the time of monitoring is determined from the thus determined value of $q_{CO}+q_{CO_2}$. In order to explain this embodiment, let us consider a case wherein $X_{14}$ and $X_{28}$ are selectively monitored in addition to $X_{44}$ and $X_A$. From the equations (2) through (4), (8) and (9), we can obtain the following equation $$q_{CO}+q_{CO_2}=(\Delta q_A/\Delta X_A)(a_1X_{14}+a_2X_{28}+a_3X_{44}) \quad (12')$$

wherein $a_1$, $a_2$ and $a_3$ are as follows.

$$a_2 = \frac{S_A}{S_{CO}} \cdot \frac{\pi_{N_2} \cdot 14}{\pi_{CO} \cdot 14 - \pi_{N_2} \cdot 14}$$

$$a_3 = \frac{S_A}{S_{CO_2}} + \frac{S_A}{S_{CO}} \cdot \frac{\pi_{CO_2} \cdot 28 \cdot \pi_{N_2} \cdot 14}{\pi_{CO} \cdot 14 - \pi_{N_2} \cdot 14}$$

Because the $a_1$, $a_2$ and $a_3$ are constants for the particular system, as noted above, they may be predetermined by repeating the same process at least three times. Once the $a_1$, $a_2$ and $a_3$ have been predetermined, it is possible to determine $q_{CO}+q_{CO_2}$, the sum of the quantities of the CO and $CO_2$ in the exhaust gas in accordance with the equation:

$$q_{CO}+q_{CO_2}=(\Delta q_A/\Delta X_A)(a_1X_{14}+a_2X_{28}+a_3X_{44})+\alpha \quad (12'')$$

wherein α is a bias coefficient, by monitoring $\Delta q_A$, $\Delta X_A$, $X_{14}$, $X_{28}$ and $X_{44}$. From the so determined value of $q_{CO}+q_{CO_2}$, the rate of decarburization (−dC/dt) and the amount of decarburization (ΔC) at the time of monitoring can be determined in accordance with the equations (10) and (11), respectively.

The second embodiment just described above is advantageous in that it is not necessary to predetermine the respective sensitivities S and pattern coefficients ρ. This embodiment is particularly useful when plural heats are repeatedly carried out under substantially the same conditions using the same installation.

In a further embodiment of the method of the invention, using Ar as the reference gas the sample of the intimate mixture of the exhaust and reference gases is mass spectrometrically monitored for $X_{28}$, $X_{40}$ and $X_{44}$, the ionization currents for peaks appearing at mass numbers of 28, 40 and 44, respectively; $q_{CO}+q_{CO_2}$, the sum of the quantities of the CO and $CO_2$ in the sample is determined in accordance with the equation:

$$q_{CO}+q_{CO_2}=b_1(X_{28}/\Delta X_{40})\cdot\Delta q_{Ar}+b_2(X_{40}/\Delta X_{40})\cdot\Delta q_{Ar}+b_3(X_{44}/\Delta X_{40})\cdot\Delta q_{Ar}+b_4$$

wherein $\Delta q_{Ar}$ is the change with time of the value of the measured quantity of Ar as the reference gas in said mixture, $\Delta X_{40}$ is the change with time of $X_{40}$, $b_1$, $b_2$, $b_3$ and $b_4$ are constants predetermined by carrying out the steel making process at least four times, and $q_{CO}+q_{CO_2}$, $X_{28}$, $X_{40}$ and $X_{44}$ are so hereinabove defined, and; the rate or amount of decarburization of the molten steel at the time of monitoring is determined from the thus determined value of $q_{CO}+q_{CO_2}$. Assuming that Q is the unknown quantity of the exhaust gas;

P is the unknown total pressure of the exhaust gas;

L is the unknown quantity of air sucked through the hood 5;

$q_{O_2}$ is the quantity of oxygen blown through the lance 3 or tuyere 18;

$C'_{Ar}$ is the content of Ar in the oxygen blown;

$T_{Ar}$ is the quantity of Ar blown through the tuyere 18, if any;

$C_{N_2}$ is the content of $N_2$ in air;

$C_{Ar}$ is the content of Ar in air;

$S_{Ar}$ is the sensitivity of the mass spectrometer for Ar;

$P_{Ar}$ is the partial pressure of Ar in the sample;

$\Delta P_{Ar}$ is the change in $P_{Ar}$ with time;

$q_{Ar}$ is the quantity of Ar in the exhaust gas;

$\Delta q_{Ar}$ is the change in $q_{Ar}$ with time caused by introduction of Ar as the reference gas, and;

$\Delta X_{40}$ is the change in $X_{40}$ with time, the following equations are materialized:

$$Q/P = \Delta q_{Ar}/\Delta P_{Ar} = q_{CO_2}/P_{CO_2} = q_{CO}/P_{CO} = q_{N_2}/P_{N_2} = q_{Ar}/P_{Ar} \quad (13)$$

$$\Delta X_{40} = S_{Ar}\Delta P_{Ar} \text{ and } X_{40} = S_{Ar}P_{Ar} \quad (14)$$

$$q_{N_2} = C_{N_2} \cdot L \quad (15)$$

$$q_{Ar} = C_{Ar}L + C'_{Ar}q_{O_2} + T_{Ar} \quad (16)$$

From the equations (3), (4), and (13) through (16), the following equation is obtained:

$$q_{CO} + q_{CO_2} = b_1 \frac{X_{28}}{\Delta X_{40}} \cdot \Delta q_{Ar} + b_2 \frac{X_{40}}{\Delta X_{40}} \cdot \Delta q_{Ar} + b_3 \frac{X_{44}}{\Delta X_{40}} \cdot \Delta q_{Ar} + b_4 \quad (17)$$

wherein $b_1$, $b_2$, $b_3$ and $b_4$ are as follows.

$$b_1 = S_{Ar}/S_{CO}$$

$$b_2 = -S_{N_2}/S_{CO} \cdot C_{N_2}/C_{Ar}$$

$$b_3 = S_{Ar}/S_{CO_2} - \pi_{CO_2 \cdot 28} \cdot S_{Ar}/S_{CO} \text{ and}$$

$$b_4 = S_{N_2}/S_{CO} \cdot C_{N_2}/C_{Ar}(C'_{Ar}q_{O_2} + T_{Ar})$$

Because the $b_1$, $b_2$, $b_3$ and $b_4$ are constants for the particular system, as noted above, they may be predetermined by repeating the same process at least four times. Once the $b_1$, $b_2$, $b_3$ and $b_4$ have been predetermined, it is possible to determine $q_{CO}+q_{CO_2}$ in accordance with the equation (17) by monitoring $X_{28}$, $X_{40}$, $X_{44}$, $X_{40}$ and $\Delta q_{Ar}$. From the so determined value of $q_{CO}+q_{CO_2}$, the rate of decarburization ($-dC/dt$) and the amount of decarburization ($\Delta C$) at the time of monitoring can be determined in accordance with the equations (10) and (11), respectively.

Based upon the determined amount of decarburization or rate of decarburization, the molten steel in the course of the decarburization process is controlled to the desired conditions. Particularly, when the decarburization process is carried out in a plurality of stages, the carbon content of the molten steel at the end point of each stage is controlled to a preset value by suitably adjusting the amount of oxygen blown, the pressure and proportions of the mixed blown gas, addition of alloying elements, removal of slags and other parameters affecting the system.

The reference gas used in a method according to the invention should be non-reactive with the exhaust gas and should not be denatured in the exhaust gas. Furthermore, the reference gas should desirably be capable of being precisely detected by the mass spectrometer irrespective of changes in the temperature and flow rate of the reference gas. In general, an inert gas, such as Ar, He or $N_2$, is suitably employed as the reference gas in the practice of the invention. In any case, however, the location in the installation where the reference gas is blown into the system and the manner of blowing (for example, whether the gas is blown continuously or intermittently) should be suitably selected depending upon the nature of the particular reference gas. For example, in the case of Ar or He, the reference gas may be introduced to the system through any one of the lance 3 (FIG. 1), tuyere 18 (FIG. 2) and reference gas inlet pipe 11. Whereas, in the case of $N_2$, blowing of the gas through the lance 3 or tuyere 18 should be avoided in order to avoid the reaction of the gas with the molten steel, and therefore, $N_2$ as the reference gas is suitably introduced to the system through the reference gas inlet pipe 11. When Ar as the reference gas is introduced to the system through the lance 3 or tuyere 18, it is generally preferable to intermittently introduce the Ar reference gas and to monitor $\Delta q_A$ and $\Delta X_A$. In the case of He, while it may be intermittently introduced to the system, it is also possible to continuously introduce it through the lance 3 or tuyere 18 and to monitor $q_A$ and $X_A$. Intermittent introduction of the reference gas is advantageous in that perturbations due to any inadvertent or intentional entrance of a gas, which is identical with the reference gas, can be prevented.

As already stated the reference gas may, depending upon the nature thereof, be introduced to the system by blowing it through the lance 3 or tuyere 18 onto or into molten steel being processed in the converter 1. In such a case, the homogenuity of the sample that is the uniform dispersion of the reference gas in the exhaust gas is ensured. However, when the reference gas is introduced to the stream of the exhaust gas in the duct 6 through the reference gas inlet pipe 11, care should be taken of the location of sampling in the duct 6 relative to the location where the reference gas is introduced to the duct 6 so that an intimate gaseous mixture of the exhaust and reference gases may be sampled. We have found the sampling should be made in the duct at a location a distance of D (in centimer) downstream of the location where the reference gas is introduced to the duct 6, which D satisfies the relation:

$$D > 0.8(R/A) = 0.8L_s$$

wherein R is the minimum rate of flow (in liter/min) of the exhaust gas in the duct 6, A is a cross-sectional area (in $cm^2$) of the duct, and $L_s$ is the minimum linear speed of the stream of the exhaust gas in the duct 6 (in $10^3$cm/min).

In practice of the invention at least a measurable amount of the reference gas should be used. Although depending upon the sensitivity for the reference gas of the particular mass spectrometer used, 0.001% by volume or more, based on the exhaust gas, of the reference gas may be typically introduced to the system at the time it is to be introduced. Obviously, it is advantageous to use the reference gas in the smallest possible amount as far as the measurements can be successfully carried out.

The invention will be further described by the following Examples.

EXAMPLE 1

Figure 3:
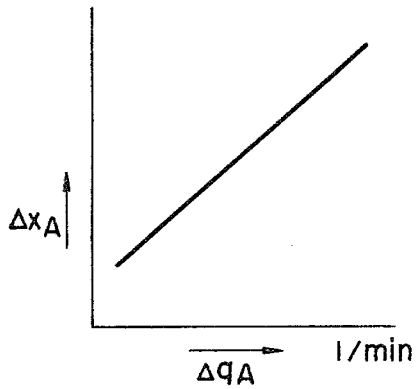
FIG. 3 is a graph revealing the fact that $\Delta q_A$, the change in the quantity of a reference gas introduced to the system in accordance with the invention is proportional to $\Delta X_A$, the change in the ionization current for the parent of the reference gas.

In a 40 ton converter as illustrated in FIG. 1, about 40 tons of a molten steel was decarburized by blowing oxygen through the lance 3. The initial composition of the molten steel was; 2.35 to 3.05% C, about 8.9% Ni, about 18.0% Cr, about 0.5% Mn, and about 0.4% Si. The intended carbon content of the molten steel at the end point was 0.30%. In the course of the decarburization process varying known quantities of argon were introduced through the lance 3. The exhaust gas was sampled by the suction pump 10 through the sample inlet pipe 8 and filter 9 to the sample inlet system of the mass spectrometer 7, and the ionization current at a mass number of 40 ($X_A$), which varied in accordance with the quantity of argon introduced to the system through the lance 3, was measured. The change in the ionization current at m/e=40, $\Delta X_A$, was revealed to be substantially proportional to the change in the quantity of argon introduced, $\Delta q_A$, as shown in FIG. 3. From the slope of the graph in FIG. 3, the sensitivity of the mass spectrometer 7 for argon was determined.

The procedure of the above described preliminary test were repeated except that varying known quantities of argon were introduced to the duct 6 through the reference gas inlet pipe 11. Substantially the same results as those shown in FIG. 3 were obtained.

In still another preliminary test, wherein the molten steel had been removed from the converter 1 and the blowing of oxygen was not carried out, the change in the ionization current $\Delta X_A$ with the change in the quantity of argon introduced to the duct 6 through the reference gas inlet pipe 11 was monitored. Similar results were obtained.

In the converter as used in the preliminary tests, 42 heats of stainless steel were carried out. In each heat, about 40 tons of a molten steel having the above-mentioned intiial composition were processed in the converter 1 by blowing oxygen thereto through the lance 3. The intended carbon content at the end point was 0.30%. For the heats Nos. 1 through 20, argon as the reference gas was intermittently introduced to the system through the flowmeter 16, piping 15 and lance 3 before, during and after the blowing of oxygen, while for the heats Nos. 21 through 42, argon as the reference gas was intermittently introduced to the duct 6 through the flowmeter 13 and reference gas inlet pipe 11. In every heat, the flow rate of argon introduced was 500 liters per minute, and the flow was stopped every 2.5 minutes for a period of 60 seconds. In each heat, a sample of the exhaust gas, that is an intimate mixture of the exhaust and reference gases was continuously introduced through the sample inlet pipe 8 and filter 9 by the suction pump 10 to the sample inlet system of the mass spectrometer 7 and was continuously monitored for ionization currents $X_{12}$, $X_{14}$, $X_{28}$, $X_{44}$ and $X_{40}$. The $X_{40}$ represents the ionization current for the parent peak of Ar, appearing at m/e=40. The measured values were recorded in a high speed recorder and processed by a computer having a program for solution of the equations (1) through (4) and (8) through (11) to determine the amount of decarburization, C%. The data obtained in the heat Nos. 1 through 5 and Nos. 21 through 25 were utilized for the calculation of the bias coefficient B in the equation (11). The mass factor W(t) relating to the expected weight of the molten steel at the time of t, was separately predetermined for each heat by the computer from the initial weight of the molten steel.

For each heat the actual content of carbon of the molten steel, C act.%, was determined at the end point of the process by sampling and subsequent chemical analysis. For all the heats Nos. 6 through 20 and Nos. 26 through 42, the difference between the value C% mass spectrometrically determined by the method of the invention and the value C act.% actually determined by chemical analysis was only within the range of ±0.04%, except for one heat.

In this example, argon as the reference gas was intermittently introduced to the system, and the difference between the value of $X_{40}$ obtained when the argon was being introduced and the value of $X_{40}$ obtained when the introduction of the argon was ceased, that is $\Delta X_A$, was monitored in order to minimize possible perturbations of $X_{40}$ due to argon which was present in the oxygen blown (normally, 0.2 to 0.3% of Ar is contained in oxygen) as well as to argon which was present in the atmospheric air sucked into the hood 5 (normally, about 0.93% of argon is contained in atmospheric air).

EXAMPLE 2

Using a 100 kg model AOD furnace as illustrated in FIG. 2, 14 heats of stainless steel were carried out.

Preliminary tests similar to those described in Example 1 revealed that $\Delta X_A$ was substantially proportional to $\Delta q_A$ for helium as the reference gas. The sensitivity of the mass spectrometer for helium was determined.

For each heat the initial composition of the molten steel was: 0.65 to 1.20% C, about 8.9% Ni, about 18.0% Cr, about 0.5% Mn and about 0.4% Si, and the blowing process was carried out intending to achieve the final content of carbon of 0.060%. The blowing process was, as in actual AOD furnaces, divided into three stages, the first stage wherein the ratio of flow of $O_2$ to Ar was 3:1, the second stage wherein the ratio of flow of $O_2$ to Ar was 2:1 and the third stage wherein the ratio of flow of $O_2$ to Ar was 1:2, and was carried out in accordance with a pattern of blowing so preset by preliminary experiments so that the carbon contents at the end of the first, second and third stages would become about 0.25%, about 0.15% and about 0.06%, respectively. For the heats Nos. 1 through 10, the furnace 1 was not inverted from the end of the first stage to the end of the third stage, while for heats Nos. 11 through 14 the process was carried out without inverting the furnace throughout the whole process. In each heat helium as the reference gas was continuously introduced to the system through the tuyere 18 during the course of as well as before and after the blowing process after having been precisely metered by means of the flowmeter 24. The rate of blow of the helium introduced was in the order of 2 liters per minute. A sample of the exhaust gas was continuously introduced through the sample inlet pipe 8 and filter 9 to the sample inlet system of the mass spectrometer 7, and was continuously monitored for the ionization currents $X_{12}$, $X_{14}$, $X_{28}$, $X_{44}$ and $X_4$. The $X_4$ represents the ionization current for the parent peak of He, appearing at m/e=4. From the measured values of these ionization currents, the amount of decarburization C% was determined in the manner as described in Example 1. The actual carbon content of the molten steel, C act.%, was chemically determined at the end point of the process for each heat. The difference between the value C% mass spectrometrically determined by the method of the invention and the value C act.% actually determined by chemical analysis was only within the range of ±0.01% for each heat.

In this Example, the reference gas, helium, was continuously introduced to the system, and $X_4$ was monitored. We have found that the ionization current at m/e=4 is not substantially perturbed by helium which might be contained in $O_2$, Ar and air entering the system. This is believed that the content of helium in such gases is as low as the order of $10^{-3}$ to $10^{-4}$%. Accordingly, when helium is used as the reference gas it may be introduced to the system continuously.

The invention brings about various advantages. In fact sampling of the molten steel being processed is not required in the practice of the method according to the invention and, therefore, it is not necessary to stop blowing and to invert the furnace for the purpose of sampling. The fact that a small volume of samples may suffice for measurements makes the means required for filtering such samples be simple and the period of time for transferring such samples to the mass spectrometer be short. Moreover, the contents of CO and $CO_2$ in the sampled gas may be determined simultaneously by one and the same instrument within a short period of time in the order of milli-seconds without necessity to measure the quantity of the entire exhaust gas. Because the monitored parameters (ionization currents) are of an electrical nature they may be directly and readily transmitted to a suitable recorder and computer for real time processing. Thus, it is possible to determine the amount or rate of decarburization every moment. Furthermore, the determination is precise and consistent.

While the invention has been described in Examples with respect to stainless steel making processes in a topblown converter or AOD furnace, the method of the invention may also be applied in making ordinary steel and/or in decarburization of molten steel in other furnaces provided that the process is carried out under atmospheric pressure and the exhaust gas comprises CO, $CO_2$ and $N_2$. Furthermore, in place of controlling the steel making process according to the integrated C% of the equation (11) and the initial C%, the process may also be controlled by utilizing the rate of decarburization determined at a certain time in conjunction with a decarburization model separately predetermined for the particular steel being prepared. Where the initial C% is not sufficiently reliable for some reason, C% of the molten steel chemically determined at a certain stage may be utilized in place thereof. Various modifications will be apparent to those skilled in the art without departing from the scope and sperit of the invention.

What we claim is:

1. A method of determining the rate of decarburization of molten steel being decarburized, which comprises;

forming an intimate gaseous mixture of the decarburization exhaust gases and a predetermined quantity of a reference gas which is inert to the exhaust gas, said exhaust gases comprising CO, $CO_2$ and $N_2$;

mass spectrometrically monitoring a sample of said mixture for the ionization currents for peaks with which the CO, $CO_2$, $N_2$ and reference gas in said sample are associated; and determining the rate of decarburization from a comparison of the quantity of the reference gas in said mixture and values of the ionization currents for the peaks.

2. In a method of making steel of a predetermined carbon content, which comprises:

providing a molten steel having a carbon content higher than said predetermined content;

decarburizing the molten steel;

determining the CO and $CO_2$ content of the exhaust gases from the decarburization;

calculating the rate of decarburization using the values obtained in said determination; and adjusting at least one of the parameters affecting the decarburization as necessary to arrive at the predetermined carbon content, based on the calculated rate of decarburization;

the improvement, which comprises;

calculating the rate of decarburization by the steps of:

forming a gaseous mixture of the exhaust gas and a measured quantity of a reference gas which is inert to the exhaust gas;

mass spectrometrically monitoring said mixture for $X_{12}$, $X_{14}$, $X_{28}$ and $X_{44}$, the ionization currents for peaks at mass numbers of 12, 14 and 28, respectively, and $X_A$, the ionization current for the parent peak of the reference gas;

calculating $P_{CO}$ and $P_{CO2}$, the partial pressures of the CO and $CO_2$ in the exhaust gas from the measured values of the ionization currents for peaks at mass numbers of 12, 14, 28 and 44 by solving the equations:

$$X_{12}=S_{CO}\cdot\pi_{CO\cdot 12}\cdot P_{CO}+S_{CO2}\cdot\pi_{CO2\cdot 12}\cdot P_{CO2} \quad (1)$$

$$X_{14}=S_{CO}\cdot\pi_{CO\cdot 14}\cdot P_{CO}+S_{N2}\cdot\pi_{N2\cdot 14}\cdot N2 \quad (2)$$

$$X_{28}=S_{N2}\cdot P_{N2}+S_{CO}\cdot P_{CO}+S_{CO2}\cdot\pi_{CO2\cdot 28}\cdot P_{CO2} \text{ and} \quad (3)$$

$$X_{44}=S_{CO2}\cdot P_{CO2} \quad (4)$$

wherein $S_{CO}$, $S_{N2}$ and $S_{CO2}$ are sensitivities of the mass spectrometer for the CO, $N_2$ and $CO_2$, respectively;

$\pi_{CO\cdot 14}$ and $\pi_{N2\cdot 14}$ are pattern coefficients, to a mass number of 14, of the CO and $N_2$, respectively;

$\pi_{CO\cdot 12}$ and $\pi_{CO2\cdot 12}$ are pattern coefficients, to a mass number of 12, of the CO and $CO_2$, respectively;

$\pi_{CO2\cdot 28}$ is a pattern coefficient of the $CO_2$ to a mass number of 28, and;

$X_{12}$, $X_{14}$, $X_{28}$, $X_{44}$, $P_{CO}$, $P_{N2}$ and $P_{CO2}$ have the meanings as defined above;

calculating $q_{CO}$ and $q_{CO2}$, the CO and $CO_2$ contents in the exhaust gas from the calculated values of the partial pressures of the CO and $CO_2$, the measured value of the quantity of the reference gas in said mixture, and the measured value of the ionization current for the parent peak of the reference gas, in accordance with the equations:

$$q_{CO}=(S_A/\Delta X_A)\cdot\Delta q_A\cdot P_{CO} \text{ and} \quad (8)$$

$$q_{CO2}=(S_A/\Delta X_A)\cdot\Delta q_A\cdot P_{CO2} \quad (9)$$

wherein $S_A$ is a sensitivity of the mass spectrometer for the reference gas, $\Delta q_A$ is the change with time of the measured value of the quantity of the reference gas in said mixture, $\Delta X_A$ is the change in $X_A$ with time, and $X_A$, $P_{CO}$ and $P_{CO2}$ have the meanings as defined above; and calculating the rate of decarburization at the time of monitoring from the thus calculated value of $q_{CO}+q_{CO2}$.

3. In a method of making steel of a predetermined carbon content, which comprises;

providing a molten steel having a carbon content higher than said predetermined content;

decarburizing the molten steel;

determining the CO and $CO_2$ content of the exhaust gases from the decarburization;

calculating the rate of decarburization using the values obtained in said determination; and adjusting at least one of the parameters affecting the decarburization as necessary to arrive at the predetermined carbon content, based on the calculated rate of decarburization;

the improvement which comprises;

calculating the rate of decarburization by the steps of:

forming a gaseous mixture of the exhaust gas and a measured quantity of a reference gas which is inert to the exhaust gas;

mass spectrometrically monitoring a sample of said mixture for $X_{44}$, the ionization current for a peak appearing at a mass number of 44, Xn and Xm selected from the group consisting of $X_{12}$, $X_{14}$ and $X_{28}$, the ionization currents for peaks appearing at mass numbers of 12, 14 and 28, respectively, and $X_A$, the ionization current for the parent peak of the reference gas;

determining $q_{CO}+q_{CO_2}$, the sum of quantities of the CO and $CO_2$ in the exhaust gas in accordance with the equation:

$$q_{CO}+q_{CO_2}=(\Delta q_A/\Delta X_A)(a_1Xn+a_2Xm+a_3X_{44})+\alpha$$

wherein $\Delta q_A$ is the change with time of the value of the measured quantity of the reference gas in said mixture, $\Delta X_A$ is the change in $X_A$ with time, $a_1$, $a_2$ and $a_3$ are constants predetermined by carrying out the steel making process at least three times, $\alpha$ is a bias coefficient, and $q_{CO}+q_{CO_2}$, $X_A$, Xn, Sm and $X_{44}$ are as hereinabove defined; and calculating the rate of decarburization of the molten steel at the time of monitoring from the thus determined value of $q_{CO}+q_{CO_2}$.

4. In a method of making steel of a predetermined carbon content, which comprises;

providing a molten steel having a carbon content higher than said predetermined content;

decarburizing the molten steel;

determining the CO and $CO_2$ content of the exhaust gases from the decarburization;

calculating the rate of decarburization using the values obtained in said determination; and adjusting at least one of the parameters affecting the decarburization as necessary to arrive at the predetermined carbon content, based on the calculated rate of decarburization;

the improvement which comprises;

calculating the rate of decarburization by the steps of:

forming a gaseous mixture of the exhaust gas and a measured quantity of argon as a reference gas;

mass spectrometrically monitoring a sample of said mixture for $X_{28}$, $X_{40}$, and $X_{44}$, the ionization currents for peaks appearing at mass numbers of 28, 40 and 44, respectively;

determining $q_{CO}+q_{CO_2}$, the sum of the quantities of the CO and $CO_2$ in the exhaust gas in accordance with the equation $$q_{CO}+q_{CO_2}=b_1\frac{X_{28}}{\Delta X_{40}}\cdot q_{Ar}+b_2\frac{X_{40}}{\Delta X_{40}}\cdot\Delta q_{Ar}+b_3\frac{X_{44}}{\Delta X_{40}}\cdot\Delta q_{Ar}+b_4$$

wherein $q_{Ar}$ is the change with time of the value of the measured quantity of argon as the reference gas in said mixture, $\Delta X_{40}$ is the change with time of $X_{40}$, $B_1$, $B_2$, $b_3$ and $b_4$ are constants predetermined by carrying out the steel making process at least four times, and $q_{CO}+q_{CO_2}$, $X_{28}$, $X_{40}$ and $X_{44}$ are as hereinabove defined; and calculating the rate of decarburization of the molten steel at the time of monitoring from the thus determined value of $q_{CO}+q_{CO_2}$.

5. The improved method of claim 2, wherein said intimate mixture of the exhaust and reference gases is formed by introducing a predetermined quantity of the reference gas in a stream of the exhaust gas, and is sampled for mass spectrometry at a location a distance of D (in centimeter) downstream of the location where the reference gas is introduced in the stream of the exhaust gas, said D satisfying the relation:

$$D>0.8L_s$$

wherein $L_3$ is the minimum linear flow speed of the stream of the exhaust gas (in $10^3$ cm/min).

6. The improved method of claim 3, wherein the reference gas is selected from the group consisting of Ar, He and $N_2$, and is intermittently introduced to the stream of the exhaust gas.

7. The improved method of claim 2, wherein the reference gas is Ar, and is intermittently introduced to the molten steel.

8. The improved method of claim 2, wherein the reference gas is H.

9. The improved method of claim 3, wherein said intimate mixture of the exhaust and reference gases is formed by introducing a measured quantity of the reference gas in a stream of the exhaust gas, and is sampled for mass spectrometry at a location a distance of D downstream of the location where the reference gas is introduced in the stream of the exhaust gas, said D satisfying the relation:

$$D>0.8L_s$$

wherein $L_s$ is the minimum linear flow speed of the stream of the exhaust gas (in $10^3$ cm/min).

10. The improved method of claim 4, wherein said intimate mixture of the exhaust and reference gases is formed by introducing a measured quantity of the reference gas in a stream of the exhaust gas, and is sampled for mass spectrometry at a location a distance of D (in centimeter) downstream of the location wherein the reference gas is introduced in the stream of the exhaust gas, said D satisfying the relation:

$$D>0.8L_s$$

wherein $L_s$ is the minimum linear flow speed of the stream of the exhaust gas (in $10^3$ cm/min).

* * * * *

UNITED STATES PATENT AND TRADEMARK OFFICE

CERTIFICATE OF CORRECTION

PATENT NO. : 4,251,270

DATED : February 17, 1981

INVENTOR(S) : Fumio Hoshi et al

It is certified that error appears in the above—identified patent and that said Letters Patent is hereby corrected as shown below:

Col. 5, line 12; - "$X_{12} = S_{CO} \cdot \pi_{CO \cdot 12} \cdot P_{CO} + S_{CO_2} \cdot \pi_{CO_2} \cdot \pi_{CO_2 \cdot 12} \cdot P_{CO_2}$"

should read --

"$X_{12} = S_{CO} \cdot \pi_{CO \cdot 12} \cdot P_{CO} + S_{CO_2} \cdot \pi_{CO_2 \cdot 12} \cdot P_{CO_2}$ --

Col. 8, line 2; - first line of equation has been omitted;

please insert --

$$a_1 = \frac{S_A}{S_{CO}} \cdot \frac{1}{\pi_{CO \cdot 14} - \pi_{N_2} \cdot 14}$$ --

UNITED STATES PATENT AND TRADEMARK OFFICE

CERTIFICATE OF CORRECTION

PATENT NO. : 4,251,270 Page 2 of 2

DATED : February 17, 1981

INVENTOR(S) : Fumio Hoshi et al

It is certified that error appears in the above—identified patent and that said Letters Patent is hereby corrected as shown below:

Col. 8, line 29; - "$\rho$" should read -- $\pi$ --

Col. 11, line 10; - "procedure" should read -- procedures --

Col. 15, line 23; - "Sm" should read -- Xm --

Signed and Sealed this

*Twenty-ninth* Day of *December 1981*

[SEAL]

*Attest:*

GERALD J. MOSSINGHOFF

*Attesting Officer*

*Commissioner of Patents and Trademarks*